US009561518B1

(12) United States Patent
Burns

(10) Patent No.: US 9,561,518 B1
(45) Date of Patent: Feb. 7, 2017

(54) LIQUID PUMP DISPENSER

(71) Applicant: Dronk, LLC, Dallas, TX (US)

(72) Inventor: Stephen Burns, Dallas, TX (US)

( * ) Notice: Subject to any disclaimer, the term of this patent is extended or adjusted under 35 U.S.C. 154(b) by 0 days.

(21) Appl. No.: 14/201,838

(22) Filed: Mar. 8, 2014

(51) Int. Cl.
*B05B 11/00* (2006.01)

(52) U.S. Cl.
CPC ..... *B05B 11/3001* (2013.01); *B05B 11/0089* (2013.01)

(58) Field of Classification Search
CPC ..... B05B 11/3015; B05B 11/3007; B05B 11/3001; B05B 11/3074; G01F 11/028; B67D 7/0205; F04B 9/14
USPC ..... 222/309, 318, 385, 383.1, 47, 384, 401
See application file for complete search history.

(56) References Cited

U.S. PATENT DOCUMENTS 1,264,554 A * 4/1918 Peron ..... B05B 11/3011 222/341
1,929,564 A * 10/1933 Rolph ..... 222/38
2,078,483 A * 4/1937 De Weal ..... B05B 11/3001 222/385
2,204,838 A * 6/1940 Walstrom ..... 222/385
3,067,915 A * 12/1962 Shapiro ..... B01L 3/0206 222/255
3,211,335 A * 10/1965 Shapiro ..... 222/50
3,223,292 A * 12/1965 Keeney ..... B05B 11/3001 222/321.9
3,228,571 A * 1/1966 O'Donnell ..... B05B 11/3001 222/182
3,653,556 A * 4/1972 Moran et al. ..... 222/309
3,940,036 A * 2/1976 Parker ..... B65D 25/48 222/530
4,057,174 A * 11/1977 Trujillo ..... B01L 3/0282 222/309
4,079,865 A * 3/1978 Kutik ..... B05B 11/3015 222/259
4,225,063 A * 9/1980 Ayres ..... B05B 11/3074 222/380
4,273,257 A * 6/1981 Smith et al. ..... 222/43
4,396,132 A * 8/1983 Christensen ..... B05B 11/3015 222/1
4,456,152 A * 6/1984 Young et al. ..... 222/309
4,526,294 A * 7/1985 Hirschmann et al. ..... 222/47
5,096,094 A * 3/1992 Guilbert ..... B05B 11/3001 222/153.13
5,123,458 A * 6/1992 Collard ..... B67D 1/08 137/883
5,152,435 A * 10/1992 Stand ..... A61F 9/0008 222/309
5,375,746 A * 12/1994 Schaefer et al. ..... 222/385
(Continued)

*Primary Examiner* — Paul R Durand
*Assistant Examiner* — Charles P Cheyney
(74) *Attorney, Agent, or Firm* — Law Office Of Sam Sokhansanj PLLC

(57) ABSTRACT

A liquid dispenser having a pumping mechanism for consistent and measured dispensing of an alcoholic liquid into a standard "shot" glass. Specifically, in one aspect of the invention, a liquid dispenser is provided having a central body member, a liquid reservoir within the central body member, and a draw tube associated with the liquid reservoir. The liquid dispenser further includes a pump shaft and a pump top connected to an upper end of the pump shaft. In addition, the dispenser is configured to couple to a vessel having a liquid in order to dispense the liquid in a measured and consistent manner in a "shot" glass, wherein the liquid can be an alcoholic beverage.

18 Claims, 4 Drawing Sheets

(56) References Cited

U.S. PATENT DOCUMENTS

| | | | | | |
|---|---|---|---|---|---|
| 5,673,824 | A * | 10/1997 | Evans | B05B 11/0005 | 222/321.1 |
| 5,687,878 | A * | 11/1997 | Smith | B05B 11/0043 | 222/321.9 |
| 5,806,721 | A * | 9/1998 | Tada | B05B 11/3001 | 222/153.13 |
| 6,530,530 | B1 * | 3/2003 | Peterson | B05B 17/08 | 222/78 |
| 7,837,064 | B1 * | 11/2010 | Robinson | B01L 3/0293 | 222/153.01 |
| 2003/0071079 | A1 * | 4/2003 | Petrovas | F04B 9/14 | 222/401 |

* cited by examiner

LIQUID PUMP DISPENSER

FIELD OF THE INVENTION

The present disclosure is related to an apparatus for dispensing a measured amount of liquid with each operation

BACKGROUND

This section is intended to introduce the reader to aspects of art that may be related to various aspects of the present invention or present solution, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Liquids are dispensed in a seemingly endless number of contexts. In dispensing liquids, accuracy in measuring the amount of liquid needed in a particular context is desirable. One such context is in the restaurant and bar industry. In the restaurant and bar industry, the success and survival of the restaurant or bar is highly dependent on the sale of liquor. In many jurisdictions, restaurants and bars pay a substantial fee to government regulatory bodies for the right to sell beverages containing liquor. In order for the proprietors of those establishments to receive an adequate return on investment in the establishment and in the corresponding liquor license, it must operate at maximum profitability.

One such area where a restaurant or bar may realize a high volume of revenue is in the sale of cocktails. But selling many cocktails will not necessarily translate into high profits. In fact, operating a bar and serving offering cocktails to patrons may lend itself to financial loss. One example of how a restaurant or bar may incur such losses is in the dispensing of cocktails. While selling cocktails can be a profitable endeavor, over-dispensing liquor to customers can be fatal to business. In preparing cocktails, the recipe for preparing the cocktail must be closely followed. A part of any drink recipe is how much liquor to include in the drink. Traditionally, liquor is applied to a cocktail in a measurement known as a "shot". A shot glass typically refers to a small glass or container that holds approximately 1.5 ounces of liquid. In many cocktail recipes, therefore, a "shot" of liquor refers to one full shot glass of liquor.

Most bars and restaurants use shot glasses in preparing a seemingly endless number of cocktails for customers. Many bars and restaurants use liquor pourers to assist in preparing cocktails. A liquor pourer is essentially a fitted spout that fits into the mouth of a liquor bottle. As most liquor bottles in the liquor industry have spouts of a standard size, liquor pourers are basically a one size fits all products.

The problem with available liquor pourers is that they provide the user with no ability to administer consistently a precise amount of liquor. In some instances, a bartender or user may forego use of a shot glass and simply "eyeball" the necessary amount of liquor to add to a cocktail. In other instances, the bartender may use a shot glass but not fill it properly and over-fill it causing spillage.

The problems caused by such inaccuracies are clear. On the one hand, if one bartender in an establishment that tends to pour less than a necessary amount of liquor in a drink, the drink may be weak or have a less then optimal taste, causing customer dissatisfaction and eventual loss of business. On the other hand, a bartender who tends to add too much liquor to a drink can also negatively impact the taste of the drink, causing customer dissatisfaction. In some circumstances, the dispensing of more than the prescribed amount of liquor may increase the enjoyment of the customer because he or she is given a strong drink. One problem with providing too much liquor to the drink, however, is that it reduces the profit margin of the drink. In cases where a bar or restaurant may be visited by acquaintances of the bartended, the tendency may be for the bartender to be over-inclusive in the dispensing of alcohol. For the establishment owner who often has many urgent matters to tend to during the hours of operation, it is virtually impossible to monitor the amount of liquor administered by the staff. There is a need, therefore, for a dispensing device that provides consistent and repetitive administering of liquor.

While many restaurant and bar owners go to great expense to meet the demands of customers and create the most enjoyable experience possible, there are many inexpensive avenues for the bar or restaurant owner to further enhance the experience. Many of the accessories associated with a bar may be mundane, but nevertheless provide a platform to increase customer enjoyment. Liquor dispensing devices are one such example. Traditionally, liquor pourers are generic items that offer no distinctiveness in terms of the restaurant or bar in which they are used or in expressing the interests of customers. What is needed is a dispensing device that is presents a cost-effective platform for further aligning a restaurant or bars with the interests of its customers.

BRIEF SUMMARY OF THE INVENTION

The liquor dispensing apparatus disclosed and described herein overcomes the limitations of currently available liquor dispensers by providing a pumping mechanism for consistent and measured dispensing of liquid.

In one aspect of the invention, a liquid dispenser is provided having a central body member, a liquid reservoir within the central body member, and a draw tube associated with the liquid reservoir. The liquid dispenser further includes a pump shaft and a pump top connected to an upper end of the pump shaft. In addition, the dispenser is configured to couple to a vessel having a liquid and wherein the dispenser is further configured to dispense the liquid. Here, the liquid can include alcohol as an ingredient. The dispenser can be further configured for dispensing the liquid into an approximately 2 US fluid ounce container. In addition, the container can be for consuming a shot of the alcohol including liquid. The dispenser can be further coupled to the opening mouth of the liquid containing vessel. Further, the liquid containing vessel can be include one or more vodka, rum, tequila, gin, whiskey, bourbon, beer, wine, sparkling wine, champagne, and spirits liquid. Also, the amount liquid to be dispensed can be adjusted by rotating a knob or cap coupled to the pump shaft or central body. The liquid dispenser can be further configured to dispense approximately 1.5 US fluid ounces in one pumping action or operation. The liquid dispenser can be further configured to dispense approximately 0.5 to 2.0 US fluid ounces in one pumping operation. In addition, the draw tube and pump top of the liquid dispenser can be interchangeable.

In another aspect of the invention, a liquid pump dispenser is provided having a central body member, a liquid reservoir within the central body member, a pump shaft, and a pump top connected to an upper end of the pump shaft. The dispenser can be configured to couple to a vessel having a liquid, wherein the dispenser is further configured to dispense the liquid from the vessel to an approximately 1 to 2 US fluid ounce container in one pumping operation. The dispenser can be further coupled to the opening mouth of the liquid containing vessel. In addition, the vessel can be an approximately 750 mL or 1.5 L bottle. The liquid dispenser can further include a draw tube configured to draw liquid from the vessel. The liquid dispenser of claim 2, wherein the draw tube is interchangeable. In addition, the liquid dispenser can further include a cap coupled to the central body. The cap can be further configured to adjust the amount of liquid to be dispensed from the dispenser.

The above summary is not intended to describe each and every disclosed embodiment or every implementation of the disclosure. The Description that follows more particularly exemplifies the various illustrative embodiments.

BRIEF DESCRIPTION OF THE DRAWINGS

The following description should be read with reference to the drawings, in which like elements in different drawings are numbered in like fashion. The drawings, which are not necessarily to scale, depict selected embodiments and are not intended to limit the scope of the disclosure. The disclosure may be more completely understood in consideration of the following detailed description of various embodiments in connection with the accompanying drawings, in which.

DETAILED DESCRIPTION

Figure 1:
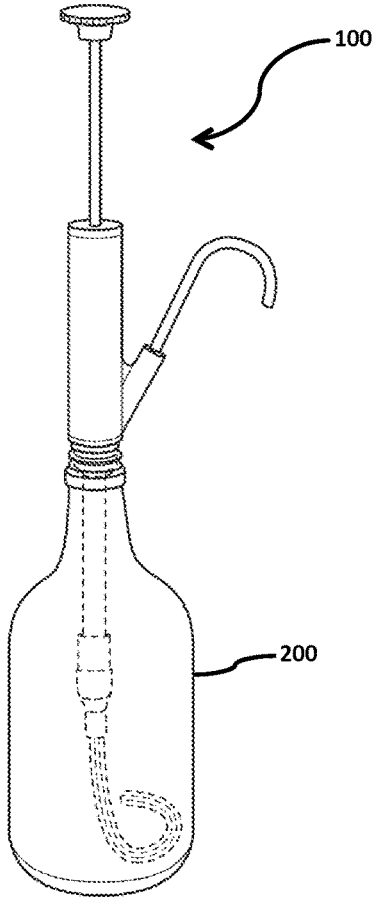
FIG. 1 illustrates an elevated perspective view of an embodiment of the present liquid dispensing apparatus coupled to a vessel.

In the Summary of the Invention above and in the Detailed Description, and the claims below, and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally. The term "comprises" and grammatical equivalents thereof are used herein to mean that other components, ingredients, steps, etc. are optionally present. For example, an article "comprising" (or "which comprises") components A, B, and C can consist of (i.e., contain only) components A, B, and C, or can contain not only components A, B, and C but also one or more other components. Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range beginning with that number, element, or ingredient (which may be a range having an upper limit or no upper limit, depending on the variable being defined). For example "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)-(a second number)," this means a range whose lower limit is the first number and whose upper limit is the second number. For example, 25 to 100 mm means a range whose lower limit is 25 mm, and whose upper limit is 100 mm.

The embodiments set forth below represent the necessary information to enable those skilled in the art to practice the invention and illustrate the best mode of practicing the invention. In addition, the invention does not require that all the advantageous features and all the advantages need to be incorporated into every embodiment of the invention. Upon reading the following description in light of the accompanying drawing figures, those skilled in the art will understand the concepts of the invention and will recognize applications of these concepts not particularly addressed herein. It should be understood that these concepts and applications fall within the scope of the disclosure and the accompanying claims.

Phrases and terms similar to "liquid" can include any type of liquid including but not limited to: water based liquids, dietary liquids, beverages, coffee based, tea based, liquor, alcohol, alcohol based, spirits, alcoholic beverage, energy drink or beverage, chemical based, dietary supplement, recreational beverage, sugar based beverage, carbonated beverage, soda, vodka, rum, tequila, gin, whiskey, bourbon, beer, wine, sparkling wine, champagne, and spirits, among others.

Figure 2:
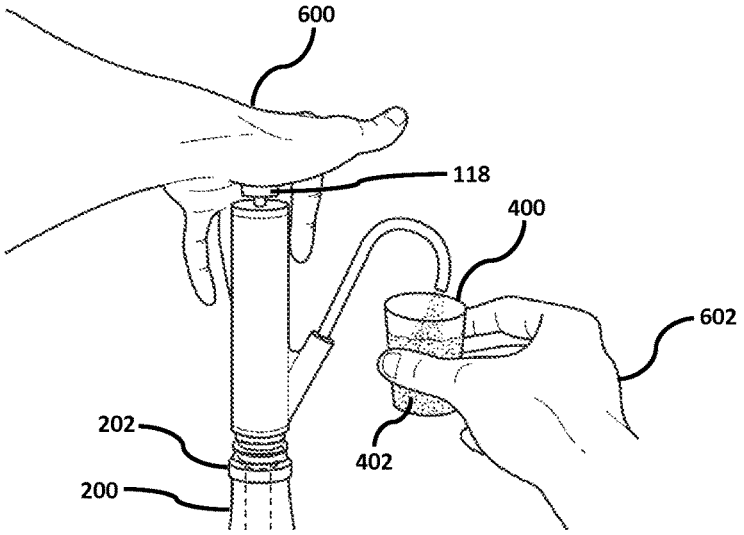
FIG. 2 illustrates an elevated perspective view of an embodiment for a method of using the liquid dispensing apparatus.

One embodiment of the present liquid dispensing pump apparatus is provided in FIGS. 1-3, 7-9. Here, liquid dispenser 100 is shown coupled to a vessel 200. More specifically, a stem 110 and draw tube 112 of the liquid dispenser is inserted into a vessel 200 for dispensing the contents of the vessel, as shown in FIG. 2. Referring to FIG. 2, liquid dispenser 100 is coupled to the mouth region 202 of bottle 100. In one embodiment, a user can use one hand 600 to press downward on a top 118 of the liquid dispenser 100 in order to dispense the liquid contents 402 (such as alcohol) into a standard 2.0 US fluid ounce container such as a shot glass or shot cup 400 held by another hand 602, thereby dispensing an exact or measured amount of liquid 402 in one pumping action into the shot glass 400. For example, the liquid amount dispensed in one pumping action or pumping operation can be from 0.5 to 2.0 US fluid ounces, preferably 1.5 US fluid ounces, or any volumetric amount pre-determined or manually set by the user, an establishment, or a manufacturer of dispenser 100.

Figure 3:
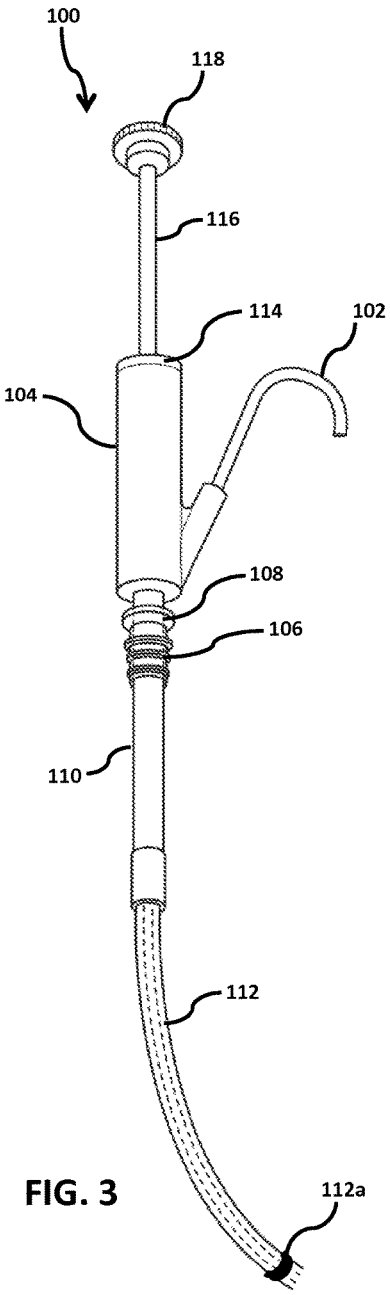
FIG. 3 illustrates an elevated perspective view of a detailed depiction of the present liquid dispensing apparatus, as assembled.
Figure 5:
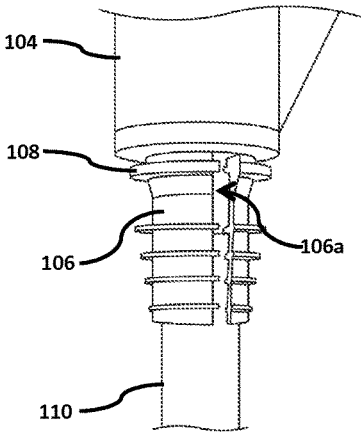
FIG. 5 illustrates a close-up perspective side view of an embodiment of a seal for the liquid dispensing apparatus.
Figure 7:
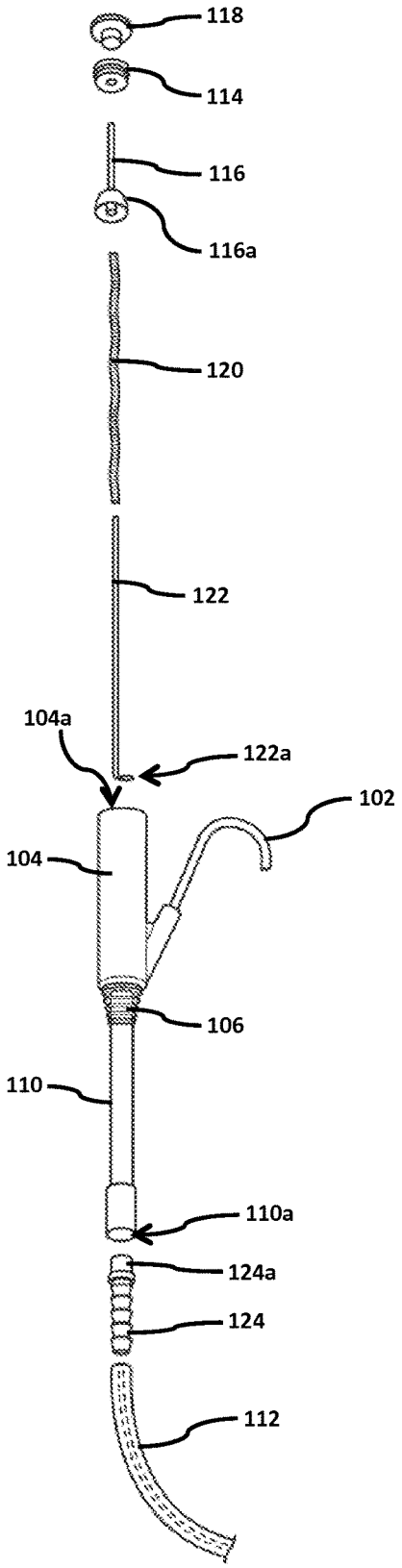
FIG. 7 illustrates an exploded perspective view of various components of the liquid dispensing apparatus.

Referring now to FIGS. 3 and 7, liquid dispenser 100 includes a spout 102 from which a liquid is poured through pump 100 from an associated bottle, such as vessel 200. Spout 102 is attached to an upper end of central body section 104 of pump 100. Within central body section 104 is a ribbed rubber stopper 106, including a flange 108. Rubber stopper 106 is of a diameter necessary to securely fit within the mouth of a standard size bottle, such as vessel or bottle 200 (such as a 750 mL or 1.5 L bottle). In the liquor industry, liquor is typically distributed in 750 mL and 1.5 L bottles. Referring to FIG. 5, rubber stopper 106 can have an elongated opening 106*a* along its length thereby allowing air to enter or leave the bottle to assist with the pumping action of dispenser 100, which will be described in detail with reference to FIGS. 8-9.

Central body section 104 includes an elongated lower section or stem 110. At the end of stem 110 is opening 110*a* for receiving in interchangeable interface 124 configured to receive an interchangeable draw tube 112. The draw tube 112 can be any type of flexible tube, hose, or straw. Draw tube 112 can also have a circular or cylindrical weight 112*a* attached to or near its end to help weigh down the end of the draw tube to the bottom floor or base of bottle 200. In one embodiment, weight 112*a* can be connected to the exterior of tube 112, in another embodiment, weight 112*a* can be disposed within the tube 112 (not shown) and having an aperture to allow liquid to flow through the weight and tube. Referring back to FIGS. 1-3 and FIGS. 7-9, interface 124 can be a ribbed hose or tube connector that can be secured on to opening 110 via a threaded engagement at 124*a*. Alternatively, tube 112 can connect directly to the distal end region of stem 110. Central body 104 further receives an elongated rod 122 having a side protruding end 122*a* that operates as a stop for the rod and compression spring 120. Compression spring 120 is disposed over rod 122, where it rests on end 122*a*.

Dispenser 100 further includes stem 116 having an elastic cylindrical seal 116*a* that gets disposed within central body 104, thereby providing a seal within the interior walls of central body 104, thereby pumping the liquid contents within body 104 wherein seal 116*a* moves in an upward and downward direction within body 104. Stem 116 is further coupled to interchangeable cap or top 118. Stem 116 also receives central body cap 114 that couples with the top end of central body 104, thereby securing the rod 122, spring 120, and seal 116*a* within body 104. Here, cap 114 has a diameter substantially equal to the diameter of shaft 116. The diameter size of shaft 116 and aperture of cap 114 are such that vertical movement of shaft 116 during operation of pump 100 is permitted without leakage of the contents of bottle 200 at the shaft 116 and aperture interface.

Figure 8:
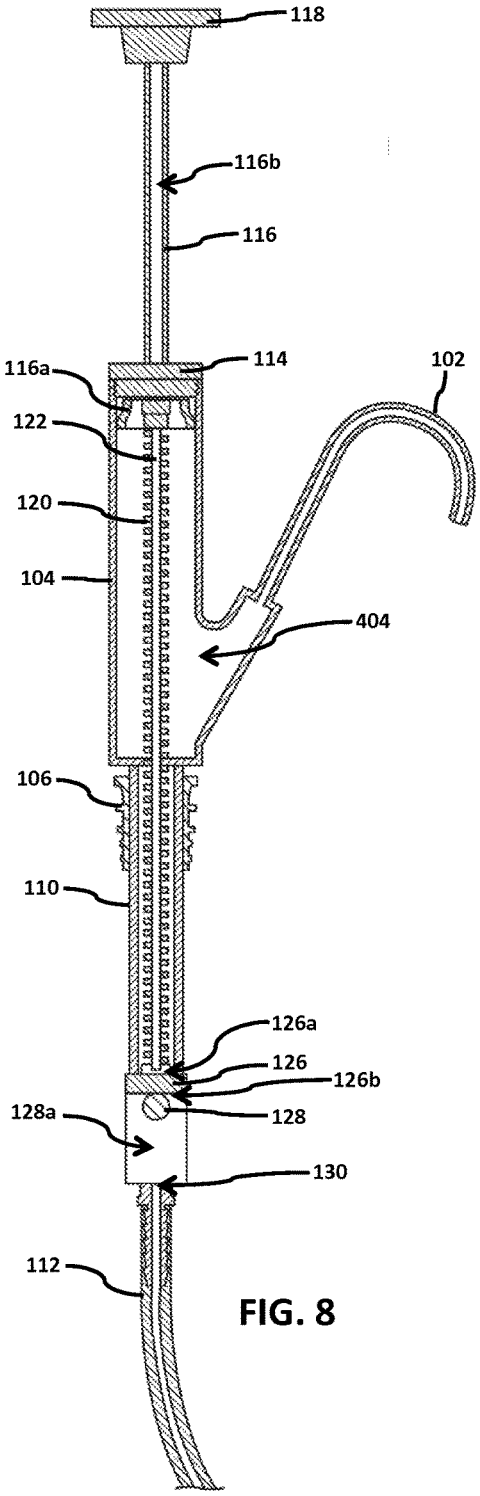
FIG. 8 illustrates a cross-section view of the liquid dispensing apparatus in a non-dispensing operation.
Figure 9:
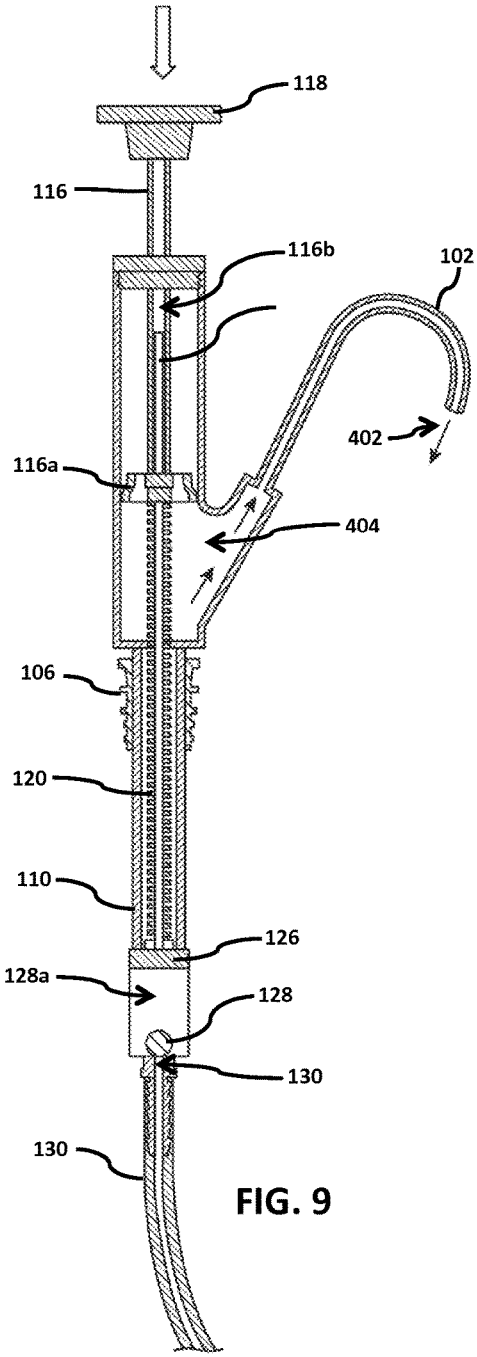
FIG. 9 illustrates a cross-section view of the liquid dispensing apparatus in a dispensing operation.

Referring to FIGS. 8-9, which illustrate cross-sectional views and method of operation for dispenser 100 in both inactive and active pumping states while coupled to a liquid holding bottle or vessel (not shown), such as bottle 200 shown in FIGS. 1-2. Here, FIG. 8 can illustrate dispenser 100 in either in an inactive empty (no substantial amount of liquid with central body 104) or inactive full state (partial or substantial amount of liquid within central body 104) and FIG. 9 can illustrate dispenser 100. In an inactive empty state, dispenser can be pumped one or more times to allow liquid to at least partially or substantially fill or drawn up into (via tube 112 and stem 110) interior chamber space 404 of body 104. Once a sufficient, partial, substantial, or full amount of liquid is within space 404 of body 104, then dispenser 100 will be in an active full state. Once in active full state, a user can exert a downward pressure or force on top 118 to drive stem 116 including seal 116*a* downward to build sufficient pressure within space 404 and push the liquid contents 402 out the spout 102 and into a shot glass, as shown in FIG. 2. Specifically, shaft 116 has a hollow interior 116*a* for receiving rod 122 within shaft 116 while shaft 116 is moving downward during the pumping action. Here, spring 120 provides a biasing means for the top, shaft, and seal and the spring is compressed as the user exerts downward pressure on top 118.

Still referring to FIGS. 8-9, as pressure builds up within 404, the pressure pushes a one-way check valve or ball valve 128 downward towards opening 130 to close-off opening 130, thereby preventing the liquid contents within the dispenser to flow back into the bottle. In contrast, as the user wants to fill the dispenser with the liquid, valve 128 moves up or opens up opening 130 to allow liquid to flow through into stem 110 and chamber 404. Dispenser 100 further includes a stop 126, which can be a single bar or meshed component, or any type of stop, that can allow liquid to flow through it while operating as a stop for both the rod 122 and spring 120 on the top surface 126*a* of stop 126 (via protrusion 122*a* of rod 122), and also a stop for ball valve 128 on the bottom surface 126*b* of stop 126.

Figure 4:
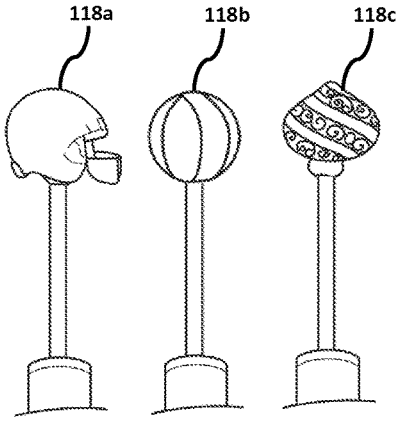
FIG. 4 illustrates elevated perspective views of various embodiments for interchangeable tops for the liquid dispensing apparatus.

FIG. 4 depicts the interchangeable top feature of the present liquid dispenser apparatus. Shaft 116 of dispenser 100 includes a threaded upper end for receiving any type of cap 118. Here, a decorative top 118*a*, 118*b*, or 118*c* includes a threaded insert sized to receive threaded upper end. Tops 118, 118*a-c* can be connected to threaded upper end of shaft 116 by rotating tops 118, 118*a-c*, typically in a counterclockwise direction until threaded upper end fully enters the threaded insert of either of tops 118, 118*a-c*, fully securing the tops to the shaft. Decorative top 118*a-c* may take many forms and can take any shape, indicia, logo, advertising, dimension, color, or configuration. For example, if an establishment using pump assembly 100 is located near a university campus, decorative top 118 may take the form of a miniature basketball bearing the university logo, similar to top 118*b*. Alternatively, if the establishment using pump assembly 100 is a sports bar that broadcasts professional football games on a weekly basis, the decorative top 118 of each pump assembly 100 may take the form of miniature helmets of some or all professional football league teams, similar to top 118*a*. Here, top 118 structurally gives the user of pump assembly 100 means for holding and operating pump assembly 100. At the same time, top 118 provides the establishment owner with a platform for enhancing the customers' visit to the establishment.

Figure 6:
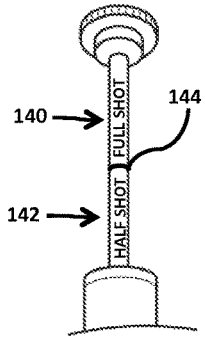
FIG. 6 illustrates a close-up perspective view of an embodiment for a shaft of the liquid dispensing apparatus.

Referring to FIG. 6, cap 114 can have a threaded engagement with the upper end of body 104, wherein cap 114 can be adjusted to vary the amount of distance shaft 116 can travel in a downward movement, thereby controlling the amount of liquid that can be dispensed, such as a full shot 140 or half shot 142. For example, cap 114 can be threaded tightly on upper end 104 in order for shaft 116 to travel in a full downward movement thereby dispensing the contents of the bottle to at least partially or substantially a full 1.5 or 2 US fluid ounces shot of liquid. Alternatively, cap 114 can be loosened from the upper end 104 (but still in threaded engagement with upper end of body 104) that reaches area 144 to limit the movement of shaft 116 to a partial or half downward movement (wherein cap 114 can operate as a stop for shaft 116) and dispense a partial 0.5 or 1.0 US fluid ounce shot of liquid. It is contemplated within the scope of the invention that cap 114 can be adjusted to any distance along shaft 116 to dispense anywhere from 0.05 US fluid ounces to 16 US fluid ounces. Further, it is contemplated within the scope of the invention that shaft 116 can have any type of indicia, markings, measurements, or labeling along the shaft to indicate the amount of liquid has will be dispensed depending on how much pressure is exerted on the downward movement of shaft 116, as shown in FIG. 2 and FIG. 6.

FIG. 3 depicts an embodiment of the interchangeable draw tube 112 system used in conjunction with dispenser 100. In the liquor industry, bottles have a standard opening size. This allows for standard sizing of the rubber stopper 106 described above. On the other hand, manufacturers of specific types of liquor provide their products in bottles of varying shapes and sizes. For example, one brand of vodka known as Grey Goose™ sells its product in a long, thin bottle. Another maker of tequila sold under the brand Patron™ offers its product in a short, wide bottle. Because of the wide variety of liquor bottle heights, a single draw tube used for all sized bottles will not be effective in drawing all of the liquor product from a single bottle. The present embodiment addresses this issue by including interchangeable draw tubes that uniquely identify the product for which they are made. In addition, rubber stopper 106 can be of any size or configuration to accommodate the type of mouth opening of any size, shape, or configuration bottle.

In one embodiment of the present liquid dispensing apparatus, draw tube 112 may be coded to correspond to the product for which it is to be applied. For example, draw tube 112 may include a bar code (or Quick Response/QR Code) that serves as an identifier of the product with which it may be used. The bar code may be read with a scanning device associated with a point of sale system used by the business establishment. Such a point of sale device is a computer having a processor and storage capability. An application or software may be provided enabling reading of the bar code and associating the bar code with a particular brand of liquor and container size. A monitor or other user interface may be associated with the point of sale device to enable a user to view the product associated with the draw tube 112. One skilled in the art of computer programming may easily develop such an application for implementation with the present embodiment of the pump system.

Another method in which the various interchangeable draw tube 112 may be associated with a particular liquor offering or container size may be through color coding. In one embodiment, an upper portion of draw tube 112 may be color coded in a manner identifying a type of liquor, such as whiskey, vodka or gin, and a lower portion of draw tube 112 may be color coded to identify the brand of that liquor. It is anticipated that a standardized coding convention will be adopted by the industry in order to allow uniform use of the present liquid dispensing apparatus and system.

From the foregoing it will be seen that this invention is one well adapted to attain all ends and objectives hereinabove set forth, together with the other advantages which are obvious and which are inherent to the invention.

Since many possible embodiments may be made of the invention without departing from the scope thereof, it is to be understood that all matters herein set forth or shown in the accompanying drawings are to be interpreted as illustrative, and not in a limiting sense.

While specific embodiments have been shown and discussed, various modifications may of course be made, and the invention is not limited to the specific forms or arrangement of parts described herein, except insofar as such limitations are included in the following claims.

What is claimed is:

1. A liquid dispenser, comprising:
- a central body member;
- a spout fixed to the central body member;
- a liquid reservoir within the central body member;
- an elongated stem coupled to the central body member;
- a draw tube coupled to the stem and associated with the liquid reservoir;
- a stopper disposed over the stem and coupled to the stem, wherein the stopper further comprises an air gap, wherein the stopper is configured to seal an opening of a vessel having a liquid therein while allowing air to flow through the air gap;
- a tubular pump shaft receiving an elongated rod, wherein the pump shaft is configured to move relative to the elongated rod and the spout;
- a pump top connected to an upper end of the pump shaft;
- a compression spring encasing the elongated rod;
- an elastic circular seal having a central region coupled to the pump shaft, the central region of the seal engaging the compression spring; and
- a meshed bottom support coupled to the stem and in direct engagement with one end of the elongated rod and one end of the compression spring, wherein the bottom support is positioned below the stopper and configured to allow the liquid to flow therethrough.

2. The liquid dispenser of claim 1, wherein the dispenser is further configured for dispensing the liquid into an approximately 2 US fluid ounce container.

3. The liquid dispenser of claim 1, further comprising the liquid dispenser configured to dispense the liquid into a container, wherein the container is for consuming a shot of the liquid.

4. The liquid dispenser of claim 1, wherein the liquid containing vessel is comprised of one or more of: vodka, rum, tequila, gin, whiskey, bourbon, beer, wine, sparkling wine, champagne, and spirits.

5. The liquid dispenser of claim 1, wherein the liquid dispenser is further configured to dispense approximately 1.5 US fluid ounces in one pumping operation.

6. The liquid dispenser of claim 1, wherein the liquid dispenser is further configured to dispense approximately 0.5 to 2.0 US fluid ounces in one pumping operation.

7. The liquid dispenser of claim 1, wherein the draw tube is interchangeable.

8. The liquid dispenser of claim 1, wherein the pump top is interchangeable.

9. A liquid dispenser, comprising:
- a central body member;
- a spout secured to the central body member;
- a liquid reservoir within the central body member;
- an elongated stem coupled to the central body member;
- an elongated rod fixed within the central body member;
- a compression spring enclosing the elongated rod;
- a horizontal mesh bottom support coupled to the stem, wherein the horizontal bottom support is in direct engagement with one end of the elongated rod and one end of the compression spring;
- a ball valve disposed below the horizontal bottom support;
- an elongated pump shaft having a hollow interior, the elongated pump shaft at least partially enclosing the elongated rod within the hollow interior, and wherein the pump shaft is configured to move relative to the spout;

a connector coupled the central body member, wherein the connector further comprises an opening for air to flow therethrough; and the dispenser configured to couple to a vessel via the connector, wherein the dispenser is further configured to dispense the liquid from the vessel into a container in one pumping action.

10. The liquid dispenser of claim 9, wherein the dispenser is further coupled to the opening mouth of the liquid containing vessel.

11. The liquid dispenser of claim 9, wherein the vessel is an approximately 750 mL or 1.5 L bottle.

12. The liquid dispenser of claim 9, further comprising a draw tube configured to draw liquid from the vessel.

13. The liquid dispenser of claim 12, wherein the draw tube is interchangeable.

14. The liquid dispenser of claim 9, further comprising a cap coupled to the central body.

15. The liquid dispenser of claim 14, wherein the cap is configured to adjust the amount of liquid to be dispensed from the dispenser.

16. A method of dispensing liquid from a liquid dispenser, the method comprising:

placing a draw tube within a vessel having a liquid, wherein the draw tube is coupled to a central body member;

coupling the central body member to the vessel;

operating a pump shaft to draw the liquid from the draw tube into a liquid reservoir of the central body member; and dispensing 1 fluid ounce to 2 fluid ounces of the liquid into a 2 fluid ounce container in one single pumping action, wherein the dispenser is further comprised of:

an elongated stem coupled to the central body member;

a tubular pump shaft;

a spout independent of the tubular pump shaft;

an elongated rod within the central body member;

a compression spring enclosing the elongated rod;

a connector coupled the central body member, wherein the connector further comprises an opening for air to flow therethrough; and the stem having a horizontal mesh bottom support, wherein the horizontal mesh bottom support is in direct engagement with one end of the elongated rod and one end of the compression spring, and wherein the bottom support is located below the connector.

17. The method of claim 16, wherein the liquid is at least partially comprised of alcohol.

18. The method of claim 16, wherein the container is further comprised of a shot glass container.

* * * * *